US006845577B1

(12) United States Patent
Downes

(10) Patent No.: US 6,845,577 B1
(45) Date of Patent: Jan. 25, 2005

(54) PACKAGE CLOSURE AND LABELING CONSTRUCTION

(75) Inventor: Robert T. Downes, Cary, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 9 days.

(21) Appl. No.: 10/655,205

(22) Filed: Sep. 4, 2003

(51) Int. Cl.[7] ..... G09F 3/14; B65D 63/00
(52) U.S. Cl. ..... 40/316; 40/665; 24/30.5 P
(58) Field of Search ..... 40/665, 669, 663, 40/637, 633; 24/30.5 P, 17 A, 16 PB, 17 AP

(56) References Cited

U.S. PATENT DOCUMENTS 712,765 A 11/1902 Cole
3,106,028 A * 10/1963 Baumgartner ..... 40/633
4,272,900 A * 6/1981 MacLarty et al. ..... 40/665
4,370,778 A 2/1983 Madsen
4,878,702 A 11/1989 Madsen et al.
5,544,391 A 8/1996 Hoffman
2003/0074821 A1 * 4/2003 Goodin et al. ..... 40/633
2004/0006852 A1 * 1/2004 Castro ..... 24/30.5 R

* cited by examiner

*Primary Examiner*—Cassandra Davis
(74) *Attorney, Agent, or Firm*—Banner & Witcoff, Ltd.

(57) ABSTRACT

A package closure and labeling construction comprises a molded plastic closure or band for fitting about gathered packaging material with an auxiliary channel formed on the band for receipt of a separate label that may be imprinted with product information unique to the package and attached to the band.

9 Claims, 2 Drawing Sheets

FIG. 3
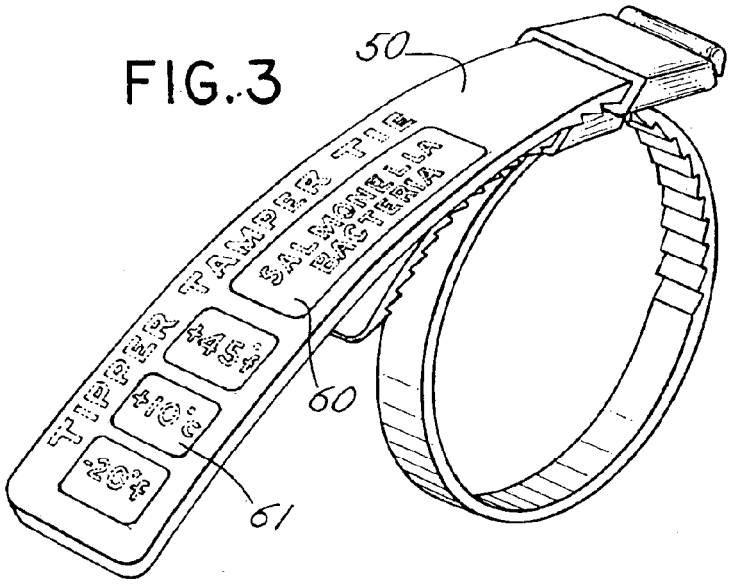
FIG. 4
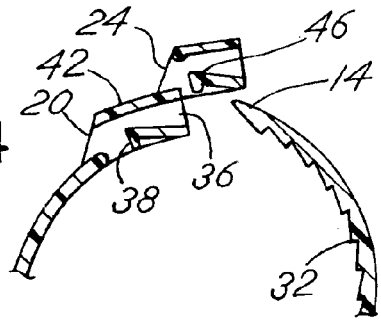
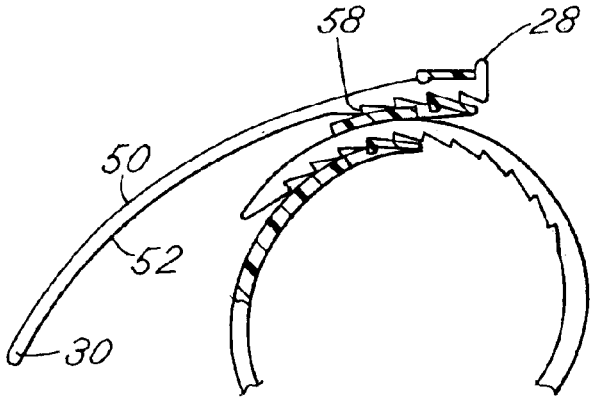
FIG. 5

PACKAGE CLOSURE AND LABELING CONSTRUCTION

BACKGROUND OF THE INVENTION

In a principal aspect, the present invention relates to a molded plastic package closure and labeling construction that may be wrapped about gathered packaging material to retain the material in a closed condition and provide labeling information relating to the package contents.

Many products, and in particular food products, are packaged in flexible bags or containers. These containers are accessible through the open top of the flexible bag. The bag, however, is typically maintained at the relevant retail outlet in a closed condition by means of a twist tie or other closure device, such as a band, or in some instances, a plastic locking tag. Such means for closure and sealing of a package are convenient and useful. Thus, over the years, various types of bag closure mechanisms have been disclosed, including the devices such as shown in U.S. Pat. No. 712,765; U.S. Pat. No. 5,544,391; U.S. Pat. No. 4,878,702; and U.S. Pat. No. 4,370,778. However, such closure devices often do not include a means for individually labeling each and every container with information relating to the contents of the container or bag.

Despite the various options for bag closure constructions and ties, as they are sometimes referred to, there remains the need for a simple, yet effective closure construction which enables ease of attachment to gathered packaging material, tight retention of the material in a gathered position, and a means for providing unique labeling associated with the contents of the packaging.

SUMMARY OF THE INVENTION

Briefly, the present invention comprises a package closure and labeling construction which is comprised of an elongate band with a first or lead end designed to fit through a channel formed at the second or gripping end of the elongate band or closure. The lead end and the gripping end each include gripping teeth or edges which will mate or engage one with the other to provide for adjustable placement of the band or closure about gathered packaging material. Further, the band includes an outside face with an auxiliary or supplemental channel formed thereon for receipt of a separate, second band or tag which may be inserted into the second channel to be retained thereby. In this manner, the second band may include information unique to the package associated with the closure construction placed on the second band or tag to then be associated with the closed package by insertion or placement into the second channel. Further, the elements of the construction may be manufactured from a molded plastic.

Thus, it is an object of the invention to provide an improved package closure construction comprised of a generally elongate band wherein the opposite ends of the band may be joined together and wherein the band includes an auxiliary mounting channel or element for receipt and retention of a second information tag associated with the package.

It is a further object of the invention to provide a closure construction which effectively seals and closes gathered packaging material.

Another object of the invention is to provide a closure construction which is capable of incorporating indicia, labeling or other identifying information on a separable label information tag or section.

Another object of the invention is to provide a label section for a package closure construction wherein the label section is capable of independently being labeled with information thereon unique to the package to which it is to be attached.

Another object of the invention is to provide an inexpensive yet easily usable and highly effective label and closure construction.

These and other objects, advantages and features of the invention will be set forth in the detailed description which follows.

BRIEF DESCRIPTION OF THE DRAWING

In the detailed description which follows reference will be made to the drawing comprised of the following figures:

FIG. 3 is an isometric view of the assembled package closure and label construction;

FIG. 4 is an enlarged cross sectional view depicting the construction with the lead end and the gripping end of the band element of the closure construction positioned for engagement and further depicting the auxiliary or second channel molded on the top of the band element; and FIG. 5 is an enlarged cross sectional view depicting the assembly of FIG. 3 and the manner in which the various component elements thereof comprising the package closure and label construction join together.

DESCRIPTION OF THE PREFERRED EMBODIMENT

Figure 1:
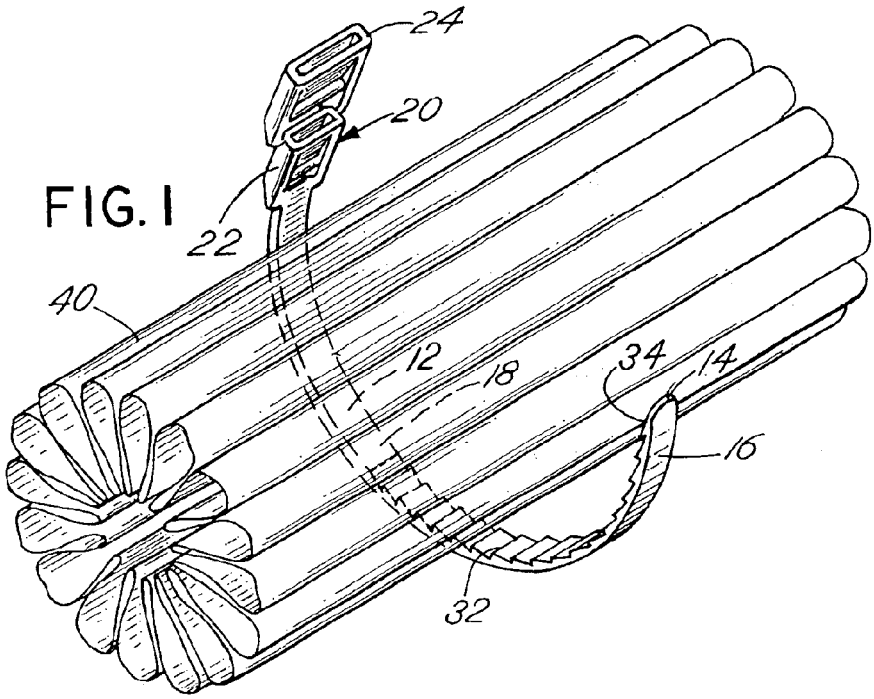
FIG. 1 is an isometric view of the improved package closure and labeling construction in combination with gathered packaging material prior to closure of the elongate strip or band, comprising an element of the construction, about the gathered packaging material.

Referring to the figures, the package label and closure construction is comprised of an elongate molded plastic band 12 having a lead end 14 with an outside surface 16 and an inside face or surface 18. The opposite end of the elongate band 12 comprises a gripping end 20 which is configured and shaped to engage and cooperate with the lead end 14. The gripping end 20 includes a first or gripping end molded throughpassage or channel 22 integrally molded onto the gripping end 20. Further, the gripping end 20 includes a second molded gripping channel 24 mounted on top of and molded on top of the first channel 22. The assembly further includes an auxiliary or information tag 26 which is an elongate tag having an outside or distal end 28 and an inner lead end 30.

Figure 2:
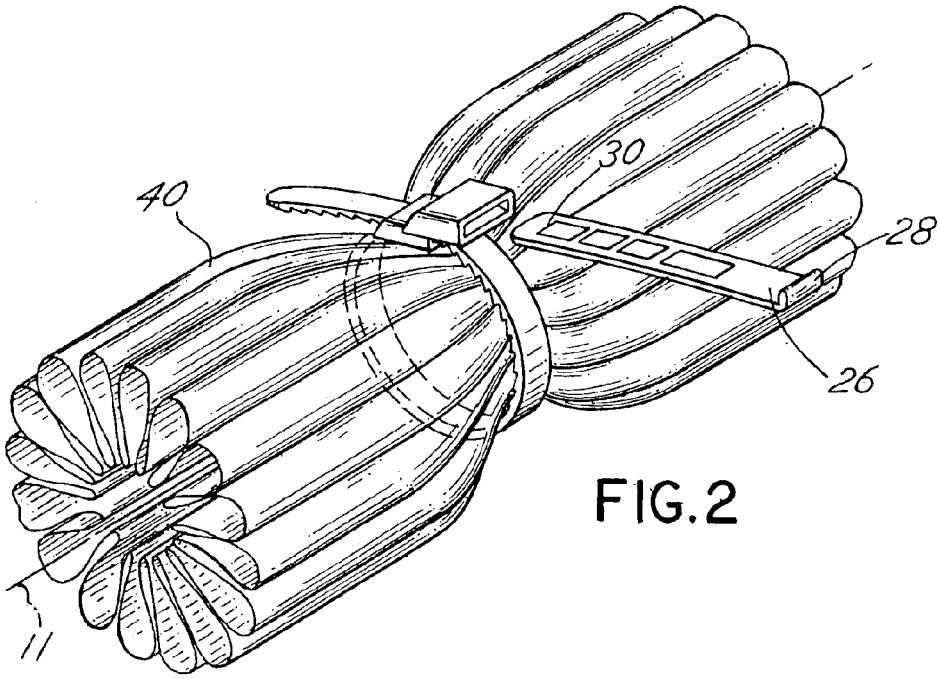
FIG. 2 is an isometric view wherein the closure and label construction of FIG. 1 has been placed about gathered packaging material and tightened about that material to retain the contents of a container or package and further depicting an information tag which is associated with the closed or sealed package.

Referring first to the construction of the lead end 14 of the elongate band 12, the outside face 16 is generally a smooth face whereas the inside face includes molded gripping teeth or ridges 32. The teeth 32, in the preferred embodiment, extend transverse to a longitudinal axis 11 of the elongate band 12. The lead end 14 includes a tapered land 34 to facilitate insertion of the lead end 14 into opening 36 molded in the first molded channel 22. The gripping end 20 thus includes the through channel 22 with an upwardly projecting rib member 38 molded therein as depicted in FIG. 4. In this manner, the lead end 14 of the elongate band may be inserted through the channel 20 so that the teeth 32 may engage with and lock against the upwardly projecting transverse rib member or tooth 38 within the channel 20 as depicted, for example, in FIG. 5. Because there are a multiplicity of teeth 32 which may engage rib member 38, the band 12 may be tightly engaged about packaging material 40 as depicted, for example, in FIG. 2.

The channel 20 includes an upper wall or top wall 42 having a second molded through channel 24. The second molded channel 24 is a through channel much like the first molded channel 20. The second molded channel 24 further includes an upwardly projecting biasing tooth or rib 46.

The second separate label or information band or tag 26 includes the lead end 30, an upper or top surface 50, a lower or under surface 52 and a rib or projection 28 at the opposite ends. Molded integrally on the bottom or under surface 52 are a series of molded teeth 58 which are adapted to cooperate with the projecting rib or tooth 46 or the second channel 24 as depicted, for example, in FIG. 5. The top surface 50 of the information tag 26 includes a generally planar display area 60 which has imprinted thereon information relating to the material within the gathered packaging 40. Thus, for example, the weight, price and identification of the goods within the packaging material or container 40 may be imprinted on the display area 60 of the band 26. Display area 60 may also include a sensor, such as a temperature sensitive strip 61 or bacteria sensitive strip. The band 26 may then be inserted through the second channel 24 in the manner depicted in FIG. 5. Thus, a display unique to the packaged item in the packaging material 40 is provided.

It is possible to vary the construction of the device depicted in numerous ways. For example, the second channel 24 is shown as being mounted upon the first channel 20. It may be positioned at a different region on the outside surface of the band 12 though the preference is as described. Further, the information tag or band 26 is depicted as having the teeth 58 for engagement with the projecting rib 46 and an upwardly projecting rib or stop member 28 so that the information tag 26 will be tightly held in position thereby preventing tampering. The position of the teeth 58 and the band 28, however, may be adjusted for retention of the band 26 at different positions along the elongate length of the band. For example, the leading end 30 of the band may include teeth on the underside or the rib on the topside. A display area would then be available on the remaining portion of the information tag 26. In this circumstance, the information tag 26 could have a width that is greater than the width of the channel 24 and thus a display area that is much larger than the display area associated with the width of the information band 26 section that passes through the channel 24. As a consequence, the auxilliary tag 26 can have many different shapes and configurations. It can also be made from many varied materials. Thus, though there has been set forth a preferred embodiment of the invention, it is to be understood that the invention is limited only by the following claims and equivalents thereof.

What is claimed is:

1. A package closure and labeling construction comprising, in combination:

an elongate band having an outside face, an inside face, a first lead end, and a second gripping end;

said first lead end including a first gripping ridge on at least one side face of the band;

said second gripping end comprised of a first through channel for receipt of the lead end, said first channel defining a first interior passage with a second gripping ridge for cooperative locking engagement with the first gripping ridge of the first lead end upon insertion of the first lead end through the first channel;

said second gripping end further including a second through channel separate from the first channel and mounted on the band on the outside face, said second channel defining a second interior passage with at least one gripping ridge, and a separate second band, said second band including all element sized to enter the interior passage of the second channel and further including (a) means for cooperative engagement with the gripping ridge of the second channel and (b) at least one product information panel whereby the information panel may be mounted to the separate second band with information thereon associated with a package to which the elongate band is affixed.

2. The construction of claim 1 wherein the at least one gripping ridges comprises a plurality of molded ribs.

3. The construction of claim 1 wherein the means for cooperative engagement with the gripping ridge comprise at least one gripping ridge.

4. The construction of claim 3 in combination with a stop rib on the separate second band for limiting sliding movement of the band in the second channel.

5. The construction of claim 1 wherein the information panel includes an environmental sensor.

6. The construction of claim 1 wherein the information panel includes a visual information panel.

7. The construction of claim 1 in the second channel is mounted on the first channel and the bands comprise elongated strips of molded plastic material.

8. The construction of claim 1 wherein the bands each include serrations comprising the gripping ridge and wherein the separate second band includes a series of the information panels.

9. The construction of claim 1 wherein the information panel comprises a temperature sensitive sensor and indicator.

* * * * *